US009314832B2

(12) United States Patent
Huang

(10) Patent No.: US 9,314,832 B2
(45) Date of Patent: Apr. 19, 2016

(54) SHEET METAL MEMBER SHAPE FORMING SYSTEM AND METHOD

(71) Applicant: Chi-Jui Huang, New Taipei (TW)

(72) Inventor: Chi-Jui Huang, New Taipei (TW)

( * ) Notice: Subject to any disclaimer, the term of this patent is extended or adjusted under 35 U.S.C. 154(b) by 481 days.

(21) Appl. No.: 13/723,558

(22) Filed: Dec. 21, 2012

(65) Prior Publication Data

US 2013/0160511 A1 Jun. 27, 2013

(30) Foreign Application Priority Data

Dec. 22, 2011 (TW) ..... 100147939 A

(51) Int. Cl.

| | |
|---|---|
| ***B21D 26/021*** | (2011.01) |
| ***B21D 26/025*** | (2011.01) |
| ***B21D 37/14*** | (2006.01) |
| ***B21D 37/16*** | (2006.01) |
| ***B21D 43/02*** | (2006.01) |

(52) U.S. Cl.

CPC ..... *B21D 26/021* (2013.01); *B21D 37/14* (2013.01); *B21D 37/16* (2013.01); *B21D 43/02* (2013.01); *B21D 26/025* (2013.01)

(58) Field of Classification Search

CPC ..... B21D 26/021; B21D 37/14; B21D 37/16; B21D 43/02; B21D 26/031; B21D 26/029; B21D 22/10; B21D 26/02; B21D 26/025; Y10T 29/49805

See application file for complete search history.

(56) References Cited

U.S. PATENT DOCUMENTS

| | | | | |
|---|---|---|---|---|
| 5,214,949 | A * | 6/1993 | Cadwell | 72/60 |
| 5,410,132 | A * | 4/1995 | Gregg et al. | 219/604 |
| 7,530,247 | B2 * | 5/2009 | Lai et al. | 72/56 |
| 8,065,899 | B2 * | 11/2011 | Frustie | 72/60 |
| 2011/0209512 | A1 * | 9/2011 | Lee | 72/60 |

* cited by examiner

*Primary Examiner* — Peter DungBa Vo
*Assistant Examiner* — John S Lowe
(74) *Attorney, Agent, or Firm* — Rosenberg, Klein & Lee

(57) ABSTRACT

A sheet metal member shape-forming system and method includes a mold consisting of a sealing die defining therein a sealing cavity and an air hole and a shape-forming die defining therein a shape-forming cavity, a compressed gas guided through the air hole into the sealing cavity, a sheet metal member placed on the shape-forming die that is pre-heated in an out-mold heating zone prior to deliver to the molding zone, a lift unit controlled to move the shape-forming die and the sheet metal member to the sealing die and to impart an upward pressure on the shape-forming die against the sheet metal member and the sealing die during continuous supply of the compressed gas into the sealing die cavity to compress the sheet metal member against the upward pressure, enabling the sheet metal member to be rapidly compression-molded into a shaped metal component.

7 Claims, 8 Drawing Sheets

SHEET METAL MEMBER SHAPE FORMING SYSTEM AND METHOD

BACKGROUND OF THE INVENTION

The present invention relates to shaped metal component production technology and, more particularly, to a sheet metal member shape forming system and method for molding a thin sheet metal member into a shaped metal component using compression molding.

Following prospective sales of 3C-information products and high-end home appliances around the world, metal shell bodies have already become basic housing for many commodities. Conventionally, there are three different sheet metal member shape forming techniques: stamping forming, vacuum forming, and compression molding. FIG. 1 is a schematic structural view of a conventional sheet metal member shape forming system.

The aforesaid prior art sheet metal member shape forming system 10 comprises a mold 11 consisting of a sealing die 111 and a shape-forming die 115. The shape-forming die 115 is placed on a worktable 19. The sealing die 111 defines therein a sealing cavity 112 and an air hole 175. The shape-forming die 111 defines therein a shape-forming cavity 116. Further, an electric heating coil 13 is arranged around the sealing die 111 and the shape-forming die 115. The electric heating coil 13 controls the heat of the mold 11 and a sheet metal member 15 that is placed within the mold 11. When the temperature of the sheet metal member 15 reaches a predetermined temperature, a high-pressure gas generator 171 is controlled to generate a high-pressure gas 179 and supplies the high-pressure gas 179 through a gas delivery pipe 173 and the air hole 175 into the sealing cavity 112. At this time, the high-pressure gas 179 gives a gas pressure Pa to the heated softened sheet metal member 15, abutting the softened sheet metal member 15 against the inner surface of the shape-forming cavity 116 subject to the effect of the gas pressure Pa, thereby forming a shaped metal component 155.

When the sheet metal member shape forming system guides the high-pressure gas 179 into the sealing cavity 112, only the holding force of the worktable 19 or the clamping force of the mold 11 can resist the gas pressure Pa in the sealing cavity 112 of the mold 11. At this time, the high-pressure gas 179 may leak out, affecting the molding speed and quality of the shaped metal component 155.

Further, if the sheet metal member 15 is directly moved from a room temperature condition into the mold 11 for heating, the high-pressure gas 179 can be applied to the inside of the sealing cavity 112 only after the sheet metal member 15 has been heated to a predetermined temperature. It takes much time to heat the sheet metal member 15 to the predetermined temperature in the mold 11, affecting the mass production speed of the shaped metal component 155.

There is known another prior art sheet metal member shape forming system, which preheats a sheet metal member 15 outside the mold 11, and then puts the pre-heated sheet metal member 15 in the mold 11 for continuous heating and further compression molding, shortening the molding speed of the desired shaped metal component 155. However, when moving the preheated sheet metal member 15 into the mold 11, the temperature of the sheet metal member 15 will fall. After the sheet metal 15 has been put in the mold 11 and heated again, the temperature of the sheet metal member 15 will rise again. Severe temperature fluctuation of the sheet metal member 15 will affect the quality of the shaped metal component 155.

Therefore, the aforesaid prior art sheet metal member shape-forming systems have the drawbacks of: easily causing product surface damage during production, being difficult to improve the molding speed, having a low yield rate, and requiring a secondary processing process due to the non-precision metal outer surface. Therefore, the prior art sheet metal member shape-forming systems and methods have room for improvement.

SUMMARY OF THE PRESENT INVENTION

It is, therefore, the main object of the present invention to provide a sheet metal member shape forming system and method, which greatly increases shaped metal component production speed and productivity, and enhances the surface effects of fabricated shape metal components.

It is another object of the present invention to provide a sheet metal member shape forming system and method, which is applicable to a variety of metal materials, widening the range of application.

It is still another object of the present invention to provide a sheet metal member shape forming system and method, which enables a lifter to continuously impart pressure on the mold to keep the sealing die and molding die of the mold in a tightly closed condition when a high-pressure fluid/gas flow is guided into the sealing cavity of the sealing die of the mold, avoiding leakage during molding and improving the quality of the shaped metal component.

It is still another object of the present invention to provide a sheet metal member shape forming system and method that keeps increasing the temperature of the sheet metal member to be molded prior to compression, and increases the pressure of the applied high-pressure fluid/gas flow step-by-step, thereby increasing shaped metal component production speed and improving the quality of the shaped metal component.

The present invention provides a sheet metal member shape forming system, comprising: a molding zone having installed therein a mold consisting of a sealing die and a shape-forming die, said sealing die defining therein a sealing cavity at least one air hole, said shape-forming die defining therein a shape-forming cavity, said shape-forming die being movable in and out of said molding zone and defined to be a working zone when entering said molding zone; at least one heater arranged around said mold and adapted for heating said mold to have said sealing die provide a predetermined working temperature; an out-mold heating zone having installed therein a standby die and an out-mold heater, said out-mold heater being adapted for heating said standby die to have said standby die provide an out-mold temperature; at least one material transfer unit adapted for transferring said standby die from said out-mold heating zone to said molding zone to allow said stand mold to become said working die; a material feeding unit adapted for feeding a sheet metal member onto a top side of said standby die outside said out-mold heating zone for enabling said sheet metal member to be moved with said standby die to said molding zone; a fluid/gas flow supply source connected to said at least one air hole of said sealing die and adapted for providing a high-pressure fluid/gas flow into said sealing cavity to impart a fluid/gas flow pressure on said sheet metal member; and a control unit connected to said heater, said out-mold heater, said material transfer unit, said material feeding unit and said fluid/gas flow supply source for controlling their operations.

The present invention provides a sheet metal member shape forming system, comprising: a mold consisting of a sealing die and a shape-forming die, said sealing die and said shape-forming die being arranged in such a manner that the distance between said sealing die and said shape-forming die is changeable, said sealing die defining therein a sealing cavity at least one air hole, said shape-forming die defining therein a shape-forming cavity, said shape-forming die being adapted for holding a sheet metal member at a top side thereof between said shape-forming die and said sealing die; a heater arranged around said mold and adapted for heating said mold; a fluid/gas flow supply source connected to said at least one air hole of said sealing die and adapted for providing a high-pressure fluid/gas flow into said sealing cavity to impart a fluid/gas flow pressure on said sheet metal member; a lift unit carrying said shape-forming die and adapted for moving said shape-forming die up and down relative to said sealing die between a mold-closing status where said shape-forming die and said sealing die are closed and a mold-opening status where said shape-forming die and said sealing die are opened, said lift unit being controllable to keep moving said shape-forming die toward said sealing die after reaching said mold-closing status to impart an upward pressure on said shape-forming die against said sealing die, said upward pressure being greater than said fluid/gas flow pressure; and a control unit connected to said lift unit, said fluid/gas flow supply source and/or said heater.

The present invention provides a sheet metal member shape forming method, comprising the steps of: starting a heater to heat a mold directly, said mold comprises a sealing die and a shape-forming die, said sealing die defining therein a sealing cavity and at least one air hole, said shape-forming die defining therein a shape-forming cavity; moving a sheet metal member to a top side of said shape-forming die between said sealing die and said shape-forming die; starting a lift unit to move said shape-forming die upwardly toward said sealing die to close said shape-forming die and said sealing die and to impart an upward pressure on said shape-forming die against said sealing die; and starting a fluid/gas flow supply source to provide a high-pressure fluid/gas flow through said at least one air hole into said sealing cavity, thereby imparting a fluid/gas flow pressure on said sheet metal member, said fluid/gas flow pressure being lower than said fluid/gas flow pressure.

The present invention provides a sheet metal member shape forming method, comprising the steps of: starting an out-mold heater to heat a shape-forming die directly in an out-mold heating zone to a predetermined out-mold temperature, shape-forming die defining therein a shape-forming cavity, said shape-forming die in said out-mold heating zone being defined as a standby die; starting a heater to heat a mold in a molding zone to a predetermined working temperature, said mold comprises a sealing die and a shape-forming die, the shape-forming die disposed in said molding zone being defined as a working die, said sealing die defining therein a sealing cavity and at least one air hole; driving a material transfer unit to move said standby die out of said out-mold heating zone to said molding zone, enabling said standby die to become said working die; driving a material feeding unit to move a sheet metal member onto said standby die after said standby die has been moved out of said out-mold heating zone and before movement of said standby die into said molding zone, and then to move said standby die and said sheet metal member into said molding zone to keep said sheet metal member between said sealing die and said working die; and starting a fluid/gas flow supply source to provide a high-pressure fluid/gas flow through said at least one air hole into said sealing cavity, thereby imparting a fluid/gas flow pressure on said sheet metal member to abut said sheet metal member against an inner surface of said shape-forming cavity for enabling said sheet metal member to be compression molded into a shaped metal component.

DETAILED DESCRIPTION OF THE PREFERRED EMBODIMENTS

Figure 1:
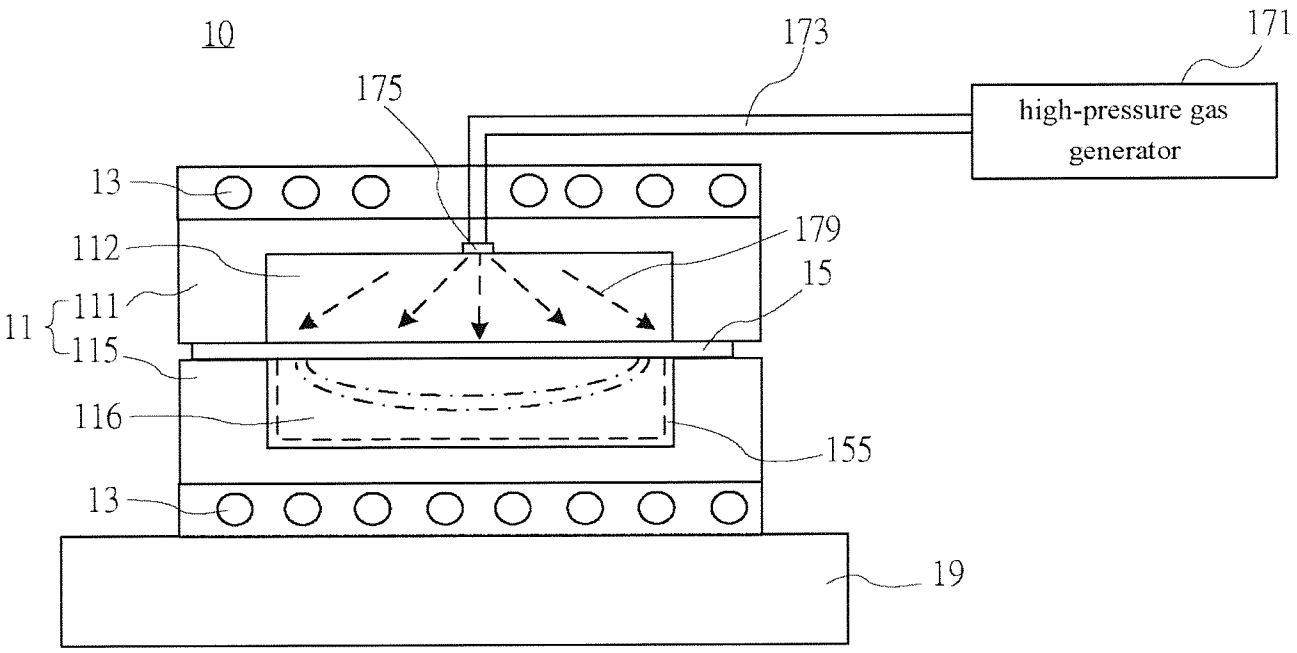
FIG. 1 (PRIOR ART)
FIG. 1 is a schematic structural view of a sheet metal member shape forming system according to the prior art.
Figure 2:
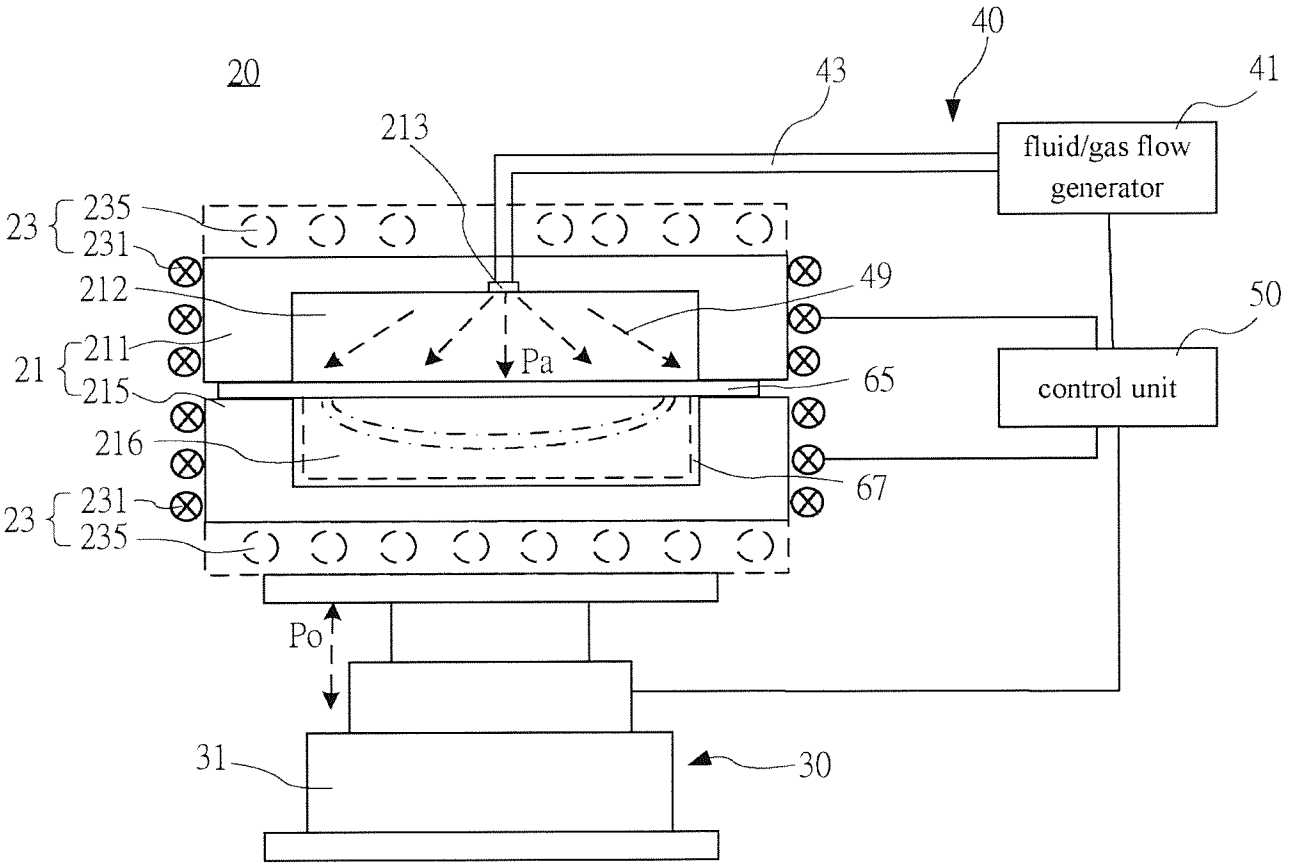
FIG. 2 is a schematic structural view of a sheet metal member shape forming system in accordance with a first embodiment of the present invention.

Please refer to FIG. 2. A sheet metal member shape forming system in accordance with a first embodiment of the present invention is shown. As illustrated, the sheet metal member shape forming system 20 comprises a mold 21, a heater 23, a lift unit 30, a fluid/gas flow supply source 40, and a control unit 50. The control unit 50 is attachable to the heater 23, the lift unit 30 and/or the fluid/gas flow supply source 40 to control their operations.

The mold 21 comprises a sealing die 211 and a shape-forming die 215. The sealing die 211 defines therein a sealing cavity 212 and an air hole 213. The shape-forming die 215 defines therein a shape-forming cavity 216. The fluid/gas flow supply source 40 comprises a fluid/gas flow generator 41, and a fluid/gas delivery pipe 43 connecting the fluid/gas flow generator 41 to the air hole 213 to deliver a high pressure fluid/gas flow 49 generated by the fluid/gas flow generator 41 to the sealing cavity 212 via the air hole 213.

In this first embodiment of the present invention, the sealing die 211 is a fixed die fixed in a predetermined position. The shape-forming die 215 is mounted at a top side of a lifter 31 of the lift unit 30, allowing change of distance between the shape-forming die 215 and the sealing die 211. Subject vertical movement of the lifter 31, the shape-forming die 215 and sealing die 211 of the mold 21 are set in a mold-closing status or mold-opening status. FIG. 2 illustrates the mold-closing status.

A sheet metal member 65 can be placed on the top side of the shape-forming die 215. The sheet metal member 65 is a thin metal sheet selected from the group of stainless steel, copper, aluminum, magnesium alloy, titanium alloy, aluminum magnesium alloy, nickel-based superalloy, tungsten, molybdenum and cobalt.

The heater 23 is set near the mold 21. For example, a high-frequency heater 231 and/or an electric heating coil 235 are respectively arranged around the sealing die 211 and the shape-forming die 215. The heater 23 can apply a heating procedure to the mold 21. By means of heating the mold 21, the heater 23 can indirectly employ a heat treatment to the sheet metal member 65 between the sealing die 211 and the shape-forming die 215.

The heating temperature of the heater 23 can be adjusted subject to the type of the sheet metal member 65. For a normally used sheet metal member 65, the heating temperature is in the 180° C.~650° C. range, however this is not a limitation.

When the mold 21 is in the mold-closing status, the fluid/gas flow supply unit 40 continuously supplies the high pressure fluid/gas flow 49 to the sealing cavity 212, and, therefore, a fluid/gas flow pressure (air pressure) Pa is formed at the top surface of the sheet metal member 65.

To avoid opening the mold or allowing gas leakage due to the formation of the fluid/gas flow pressure Pa in the sealing cavity 212 of the mold 21, the lifter 31 keeps moving the shape-forming die 215 toward the sealing die 211. This upward push force imparts an upward pressure Po on the mold. The fluid/gas flow pressure Pa produced by the high pressure fluid/gas flow 49 and the upward pressure Po produced by the lifter 31 forces the heated softened sheet metal member 65 against the inner layer of the shape-forming cavity 216, forming a shaped metal component 67, as indicated by the imaginary line.

The high pressure fluid/gas flow 49 can be a high pressure flow of a gas or fluid, preferably, the high pressure fluid/gas flow 49 is a high pressure flow of gas that can be general gas, air, helium (Hi), neon (Ne), nitrogen (N2), or any other inert gas or inactive gas. In this first embodiment, the high pressure gas flow 49 is in the range 150 Bar~400 Bar. However, this range is not a limitation.

The lifter 31 can be a hydraulic machine or pneumatic machine, however, hydraulic machines are better. In this first embodiment, the output tonnage of the hydraulic machine 31 is in the range 80 tons~240 tons. However, this range is not a limitation.

In this first embodiment of the present invention, during forming of a shaped metal component 67, the control unit 50 controls the lifter 31 to provide an upward pressure Po is constantly greater than the fluid/gas flow pressure Pa of the high pressure fluid/gas flow 49. The upward pressure Po is greater than the fluid/gas flow pressure Pa by about 10%~40%, preferably in the range 18%~27%.

Figure 3:
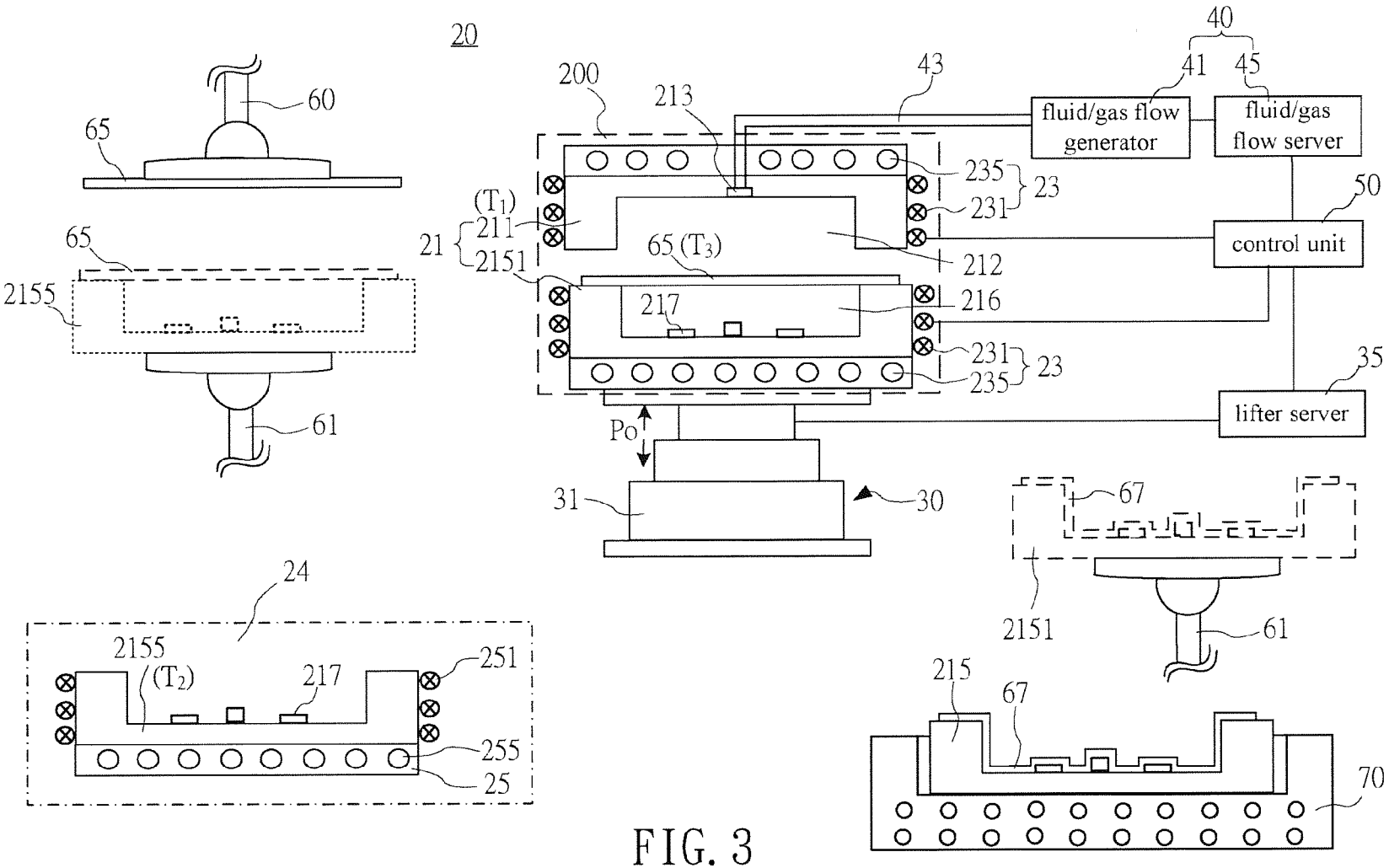
FIG. 3 is a schematic structural view of a sheet metal member shape forming system in accordance with a second embodiment of the present invention.

Referring to FIG. 3, a sheet metal member shape forming system in accordance with a second embodiment of the present invention is shown. This second embodiment is substantially similar to the aforesaid first embodiment with the exception that this second embodiment further comprises an out-mold heating zone 24, a material transfer unit 61 and a material feeding unit 60 that are all disposed at one lateral side relative to the mold 21.

In order to increase the mass production and yield rate of the shaped metal component 67, the sealing die 211 can be fixedly maintained under a predetermined working temperature T1, and another mold, hereinafter referred to as standby die 2155, is provided to the out-mold heating zone 24 during pressure forming of a sheet metal member 65 in the mold 21 at a molding zone 200. The standby die 2155 is heatable by an out-mold heater 25 to an out-mold temperature T2. The out-mold heater 25 can be an electric heating coil 255, a high-frequency heater 251, or their combination.

When a shaped metal component 67 is made in the molding zone 200, the material transfer unit 61 is controlled to transfer the shaped metal component 67 and the die under working (hereinafter referred to as working die 2151) out of the molding zone 200 to the atmospheric environment or a cooling trough 70, as shown in the lower right side of the drawing. At this time, the standby die 2155 is moved to the mold 21 in the molding zone 200, subject to the operation of the material transfer unit 61. During transfer of the standby die 2155, another sheet metal member 65 is transferred from a room temperature environment to the top side of the standby die 2155 by the operation of the material feeding unit 60, as shown in the upper left side in the drawing, and then transferred with the standby die 2155 to the top side of the lifter 31. At this time, the standby die 2155, at the lifter 31, works as another working die 2151.

In this embodiment, the material feeding unit 60 and the material transfer unit 61 can be connected to the control unit 50 and controlled by the control unit 50 to move the sheet metal member 65, the standby die 2155, the working die 2151 and/or the shaped metal component 67 at proper time periods. Of course, a respective independent mechanical arm, handwheel or operator can be selectively used to substitute for the material feeding unit 60 and the material transfer unit 61 for manual transfer.

Each sheet metal member 65 is kept under room temperature and not heated before being transferred to the top side of the standby die 2155, and will be indirectly heated and moved with the standby die 2155 to the top side of the lifter 31 only after it has been placed on the standby die 2155. After reaching the top side of the lifter 31, this sheet metal member 65 will be continuously heated by the heater 23 of the mold 21. During movement, heating and compression molding, the sheet metal member temperature T3 continues to increase or remains constant, avoiding a sudden temperature change. Therefore, the product quality of a shaped metal component 67 made according to the present invention will be much better than a shaped metal component 155 made according to the prior art method.

Further, in order to let the temperature of the standby die 2155 rapidly reach the predetermined working temperature T1 of the sealing die 211 after shifting to the molding zone 200, the out-mold temperature T2 of the standby die 2155 is set to be higher than the predetermined working temperature T1. During transfer of the standby die 2155, the out-mold temperature T2 of the standby die 2155 will fall slightly to become equal or approximately equal to the predetermined working temperature T1 due to the heat absorption effect of the sheet metal member 65 and the atmosphere, facilitating the heating effect of the heater 23 of the mold 21.

In this embodiment, the lift unit 30 comprises a lifter 31 and a lifter server 35. The lifter server 35 is connected to the lifter 31 and the control unit 50, and controllable through the control unit 50 to move the lifter 31 upwards or downwards.

In this embodiment, the fluid/gas flow supply source 40 comprises a fluid/gas flow generator 41 and a fluid/gas flow server 45. The fluid/gas flow server 45 is connected to the fluid/gas flow generator 41 and the control unit 50, and controllable through the control unit 50 to determine the amount of high-pressure fluid/gas flow 49 to be provided by the fluid/gas flow generator 41 to the sealing cavity 212, or to be discharged out of the sealing cavity 212.

Further, a pattern layer 217 can be directly provided at the inner surface of the die 2151/2155 for forming a pattern on the outer surface of each shaped metal component 67. The pattern can be graphical, striped, a configuration, glossy [surface], frosted [surface], text and/or other content representative means. When the sheet metal member 65 under molding is heated to the expected temperature and compressed by the applied fluid/gas flow pressure Pa, it is then abutted against the inner surface of the working die 2151 and embossed by the in-out design of the pattern layer 217. After compression molding and demolding, the outer surface of the shaped metal component 67 exhibits the design of graphics, stripes, configuration, glossy surface, frosted surface, text and/or other content representative means.

Figure 4:
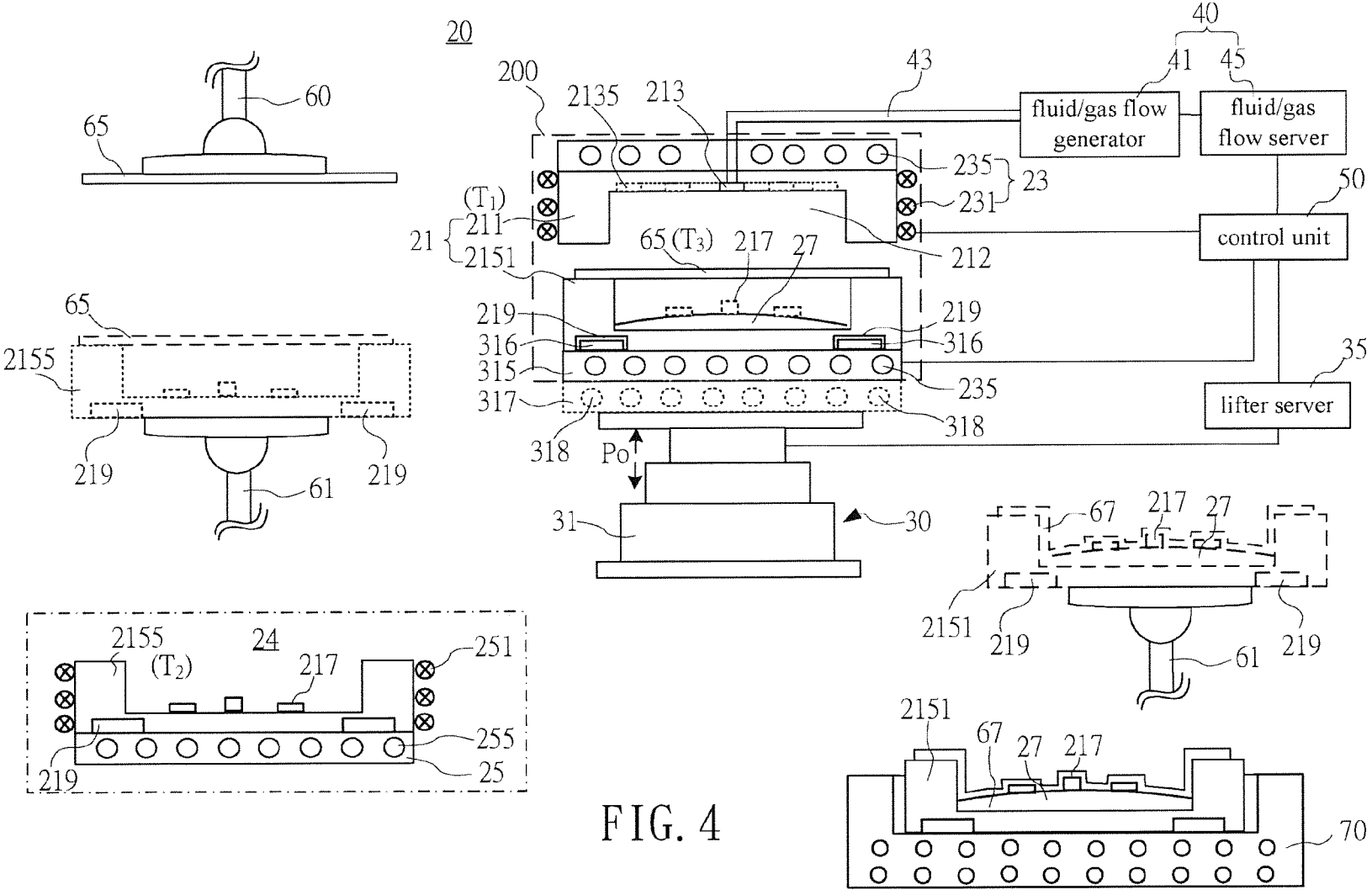
FIG. 4 is a schematic structural view of a sheet metal member shape forming system in accordance with a third embodiment of the present invention.

Referring to FIG. 4, a sheet metal member shape forming system in accordance with a third embodiment of the present invention is shown. This third embodiment greatly increases the shaped metal component production speed and productivity. Further, this third embodiment is substantially similar to the aforesaid second embodiment with the exception of the following features. A carrier 315 is provided at the top side of the lifter 31, having set therein a heater, for example, an electric heating coil 235. The carrier 315 comprises one or multiple sliding rails 316 arranged at the top side thereof. Each die 215 (for example, the working die 2151 and the standby die 2155 shown in the drawing) comprises one or multiple sliding grooves 219 located on the bottom side thereof couplable to the one or multiple sliding rails 316 of the carrier 315 for enabling the die 215 to be easily moved along the carrier 315. Thus, after formation of the shaped metal component 67, the material transfer unit 61 can carry the working die 2151 and the shaped metal component 67 out of the molding zone 200 rapidly for reception of the next processing step, such as cooling, demolding, tempering, or any other post processing step. A next standby die 2155 can then be rapidly carried into the molding zone 200 to become a next working die 2151 to form with the sealing die 211 a complete mold 21.

Of course, the positions of the sliding rail 316 and the sliding groove 219 can be exchanged, i.e., the sliding rail 316 can be provided at the bottom side of the shape-forming die 215, and the sliding groove 219 can be provided at the carrier 315.

Further, the shape-forming die 215 comprises a nucleolus 27 at the inner surface thereof. The top surface of the nucleolus 27 can be a smooth surface or provided with a patterned layer 217. When the sheet metal member 65 is heated and compressed, the softened sheet metal member 65 is abutted against the top surface of the nucleolus 27 or patterned layer 217, forming a shaped metal component 67.

Further, in order to allow the sheet metal member 65 in the sealing cavity 212 to be rapidly and uniformly compressed by the fluid/gas flow pressure Pa, a plurality of air holes 213; 2135 are formed in the sealing die 211. The border air holes 2135 can be directly connected to the center air hole 213, or directly connected to the gas delivery pipe 43, enabling the internal pressure of the sealing cavity 212 to be rapidly increased or equalized.

Further, during operation, the mold 21 can be heated to several hundred degrees Celsius. In order to protect the lifter 31 from this high temperature, a heat-insulating member 317 is set between the lifter 31 and the shape-forming die 215, and a cooling pipe or cooling water channel 318 is set in the heat-insulating member 317. By means of the heat-insulating member 317 and/or the cooling pipe or cooling water channel 318, thermal insulation between the lifter 31 and the shape-forming die 215 is achieved.

Figure 5:
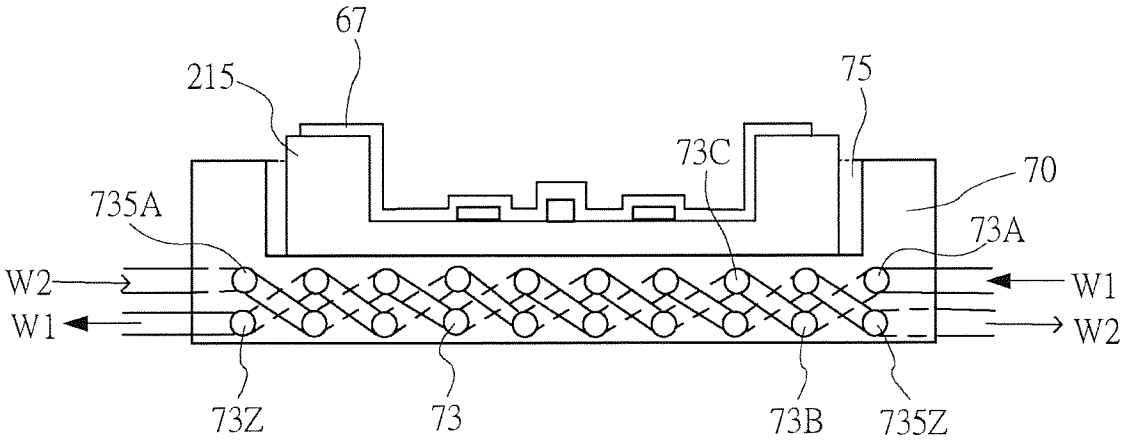
FIG. 5 is a schematic structural view of a cooling trough for a sheet metal member shape forming system in accordance with the present invention.

Referring to FIG. 5, a schematic structural view of a cooling trough for a sheet metal member shape forming system in accordance with the present invention is shown. After formation of the shaped metal component 67, the material transfer unit 61 carries the shape-forming die 215 (the working die 2151) and the shaped metal component 67 away from the molding zone 200 into a cooling trough 70. The cooling trough 70 has a connected series of condenser pipes 73 passing therethrough to maintain the cooling trough 70 at a low temperature level. The low temperature of the cooling trough 70 can lower the temperature of the shape-forming die 215 directly and the temperature of the shaped metal component 67 indirectly, thereby protecting surface integrity of the shaped metal component 67 and accelerating cooling and demolding of the shaped metal component 67. The condenser pipes 73 can be water channels or pipelines that allow a condensing fluid W1 to pass therethrough.

As illustrated, the connected series of condenser pipes 73 extends horizontally through the bottom wall of the cooling trough 70. As illustrated, the condensing fluid W1 is delivered through the connected series of condenser pipes 73 that extends from an upper right position point 73A at the front side of the cooling trough 70 horizontally through the bottom wall of the cooling trough 70 to the back side of the cooling trough 70, and then guided leftwardly and downwardly to a relatively lower position point 73B at the back side of the cooling trough 70, as illustrated by the imaginary line. The condensing fluid W1 is then guided from the position point 73B at the back side of the cooling trough 70 horizontally through the bottom wall of the cooling trough 70 to the front side of the cooling trough 70, and then guided leftwardly and upwardly to a position point 73C at the back side of the cooling trough 70, as illustrated by the real line. The condensing fluid W1 is then guided from the position point 73C at the front side of the cooling trough 70 horizontally, through the bottom wall of the cooling trough 70 to the back side of the cooling trough 70, and then guided leftwardly and upwardly to another position, and then guided repeatedly in a similar manner through the bottom wall of the cooling trough 70 horizontally and to different elevation points at the front and back sides of the cooling trough 70, and finally to an output position 73Z at the front side of the cooling trough 70 for output.

Alternatively, the cooling trough 70 can be designed to accommodate a cooling fluid or liquid 75 without the aforesaid condenser pipes 73. After the shape-forming die 215 is placed in the cooling trough 70, the cooling fluid or liquid 75 is caused to circulate around the shape-forming die 215, thereby cooling the shaped metal component 67 for quick demolding and protecting surface integrity of the shaped metal component 67.

Figure 6:
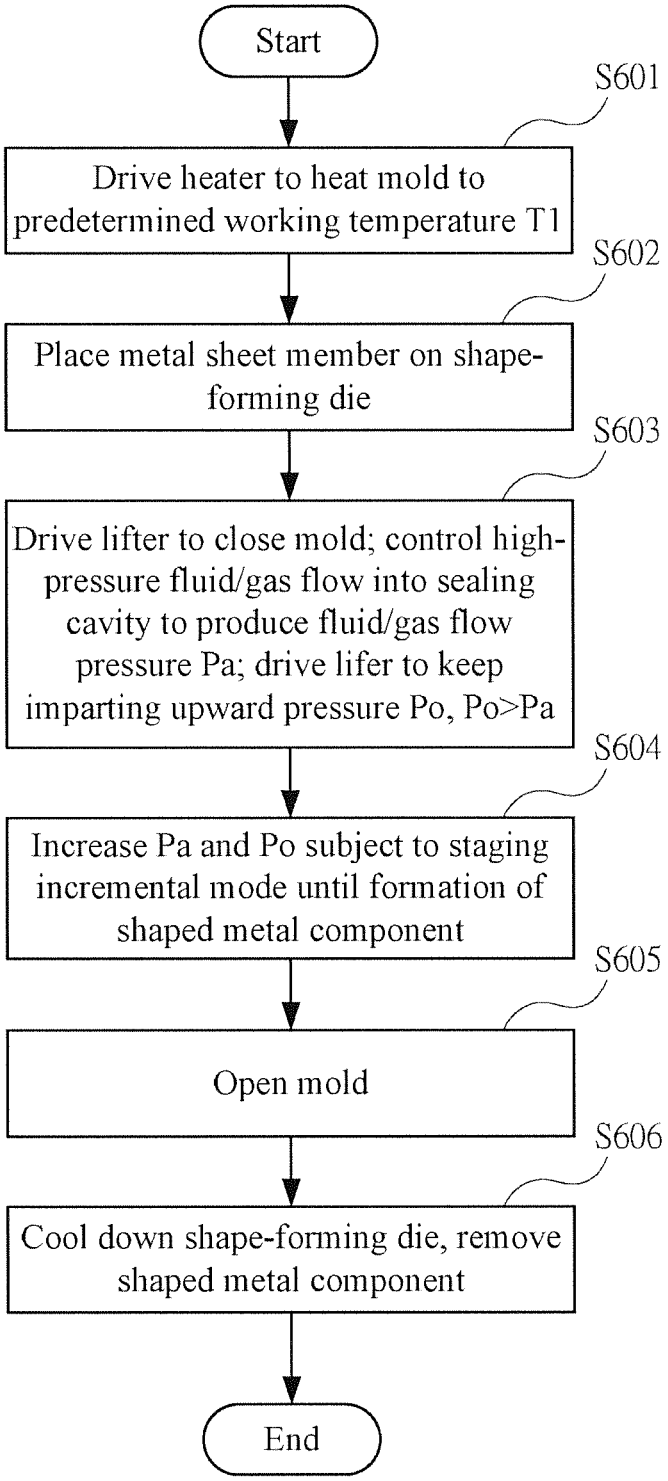
FIG. 6 is a flow chart of a sheet metal member shape forming method in accordance with the present invention.

Referring again to FIG. 2 and FIG. 6, a sheet metal member shape forming method in accordance with the present invention is applied to the sheet metal member shape forming system shown in FIG. 2, comprising the following steps:

Step S601 The control unit 50 controls and drives the heater 23 to heat the opened mold 21 to a predetermined working temperature T1.

Step S602 The material feeding unit 60 (see FIG. 3) is controlled to move a sheet metal member 65 onto the top side of the shape-forming die 215, and the heater 23 is controlled to continue heating the mold 21 directly.

Step S603 The control unit 50 controls and turns on the lift unit 30, moving the lifter 31 to lift the shape-forming die 215 upwardly toward the sealing die 211, thereby closing the mold 21, and at this time, the sheet metal member 65 is kept between the sealing die 211 and the shape-forming die 215 and indirectly heated by the heater 23 via the sealing die 211 and the shape-forming die 215.

When the mold 21 is closed or the lifter 31 is started, the fluid/gas flow supply source 40 starts to provide a high-pressure fluid/gas flow 49 to the sealing cavity 212 through the gas delivery pipe 43 and the air hole 213, imparting a fluid/gas flow pressure Pa on the inside of the sealing cavity 212 and the surface of the sheet metal member 65. At the same time, the lifter 31 of the lift unit 30 continues moving the shape-forming die 215 upwardly to give an upward pressure Po to the mold 21. This upward pressure Po is greater than the fluid/gas flow pressure Pa (Po>Pa). Because the upward pressure Po provided by the lifter 31 is greater than the fluid/gas flow pressure Pa provided by the high-pressure fluid/gas flow 49, the applied fluid/gas flow pressure Pa does not cause the mold 21 to leak.

Step S604 The upward pressure Po provided by the lifter 31 and the fluid/gas flow pressure Pa provided by the high-pressure fluid/gas flow 49 are respectively increased, stage-by-stage, thereby enabling the fluid/gas flow pressure Pa to force the softened sheet metal member 65 to be against the inner surface of the shape-forming die 215, forming a shaped metal component 67. Thus, the desired shaped metal component 67 is obtained.

Step S605 The control unit 50 controls the lifter 31 of the lift unit 30 to move the shape-forming die 215 and the shaped metal component 67 downwardly away from the sealing die 11, i.e., performing a mold-opening procedure.

Step S606 When the shaped metal component 67 is cooled down to a predetermined temperature level, the shaped metal component 67 is removed from the shape-forming die 215, thus completing this sheet metal member shape forming process.

Figure 7:
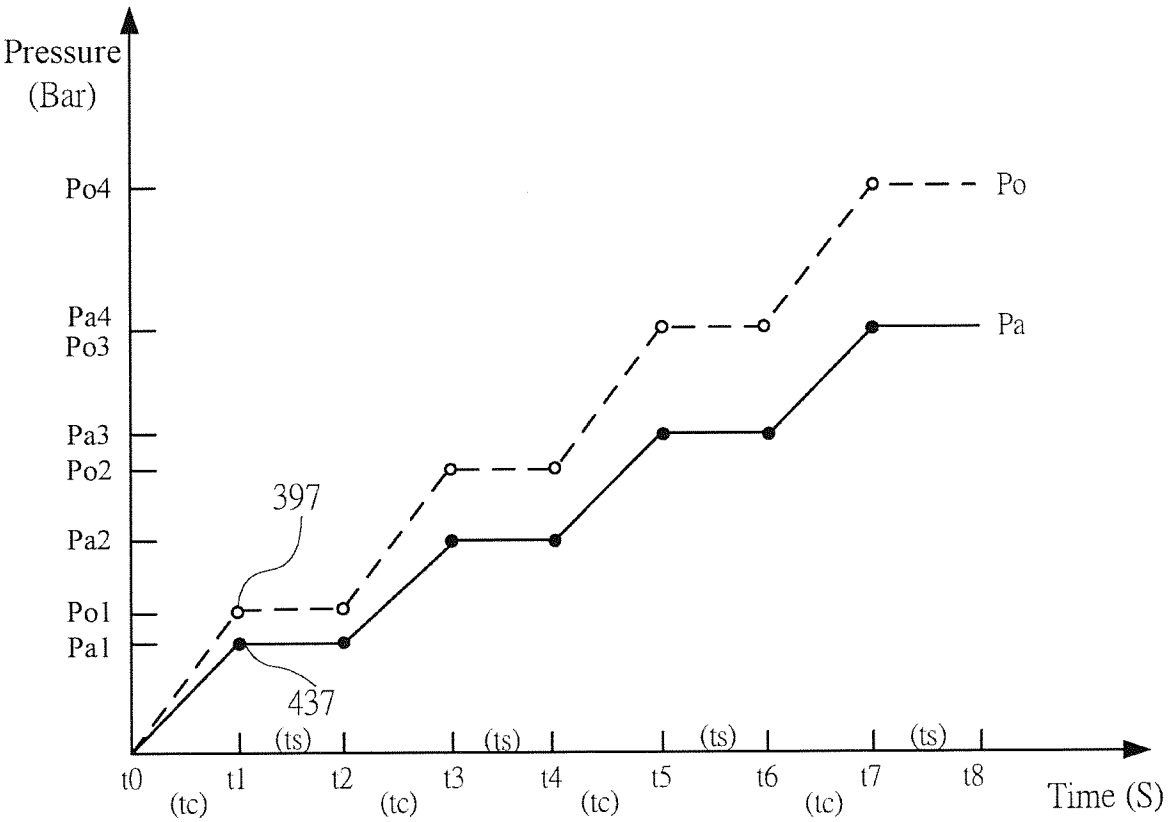
FIG. 7 is a pressure-time distribution curve obtained during a sheet metal member shape forming process in accordance with the present invention.

During Step S604, the upward pressure Po and the fluid/gas flow pressure Pa are respectively increased, stage-by-stage, as illustrated in FIG. 7. The time period where the sheet metal member 65 is compression-molded into the shaped metal component 67 is defined as a forming time period, for example, t0~t8. This forming time period is controlled by control unit 50, comprising at least one variation time segment (tc; t0~t1, t2~t3, t4~t5 and t6~t7) and at least one stagnation time segment (ts; t1~t2, t3~t4, t5~t6 and t7~t8). During the first variation time segment tc (t0~t1), the control unit 50 controls the fluid/gas flow pressure Pa to be increased to a predetermined fluid/gas flow pressure value 437 (Pa1), and the upward pressure Po to be increased to a predetermined upward pressure value 397 (Po1). During the successive first stagnation time segment ts (t1~t2), the control unit 50 controls the predetermined fluid/gas flow pressure value Pa1 and the predetermined upward pressure value Po1 to be maintained unchanged to keep compressing the sheet metal member 65.

Subject to the material properties of the sheet metal member 65 used, a second variation time segment tc (t2~t3) may follow the first stagnation time segment ts (t1~t2). During this second variation time segment tc (t2~t3), the fluid/gas flow pressure Pa will be increased to another predetermined fluid/gas flow pressure value Pa2, and the upward pressure Po will be increased to another predetermined upward pressure value Po2. Further, during the successive second stagnation time segment ts (t3~t4), the predetermined fluid/gas flow pressure value Pa2 and the predetermined upward pressure value Po2 are maintained unchangingly to keep compressing the sheet metal member 65. And so on, until the shaped metal component 67 is done.

In other words, the fluid/gas flow pressure Pa and the upward pressure Po are increased, step-by-step, to compress the sheet metal member 65 and the mold 21. This staging incremental mode includes at least one variation time segment stagnation time segment ts. During each variation time segment tc, the fluid/gas flow pressure Pa and the upward pressure Po are increased; during every stagnation time segment ts, the fluid/gas flow pressure Pa and the upward pressure Po are maintained unchanged.

In one example of the present invention, at the same time period, the predetermined upward pressure value (Po1, Po2, Po3, Po4) is greater than the predetermined fluid/gas flow pressure value (Pa1, Pa2, Pa3, Pa4). The upward pressure Po is preferably greater than the fluid/gas flow pressure Pa by about 10%~40%, or most preferably by about 18%~27%.

In another example of the present invention, the control unit 50 controls the heater 23 to continue heating during the time period the sheet metal member 65 is being compression-molded into the shaped metal component 67, keeping the sheet metal 65 under a predetermined temperature level.

Of course, in a different example, the control unit 50 can control the heater 23 to continue heating and can control the heater 23 to increase the working temperature of the sheet metal member 65 subject to increase the upward pressure Po and/or fluid/gas flow pressure Pa.

Figure 8:
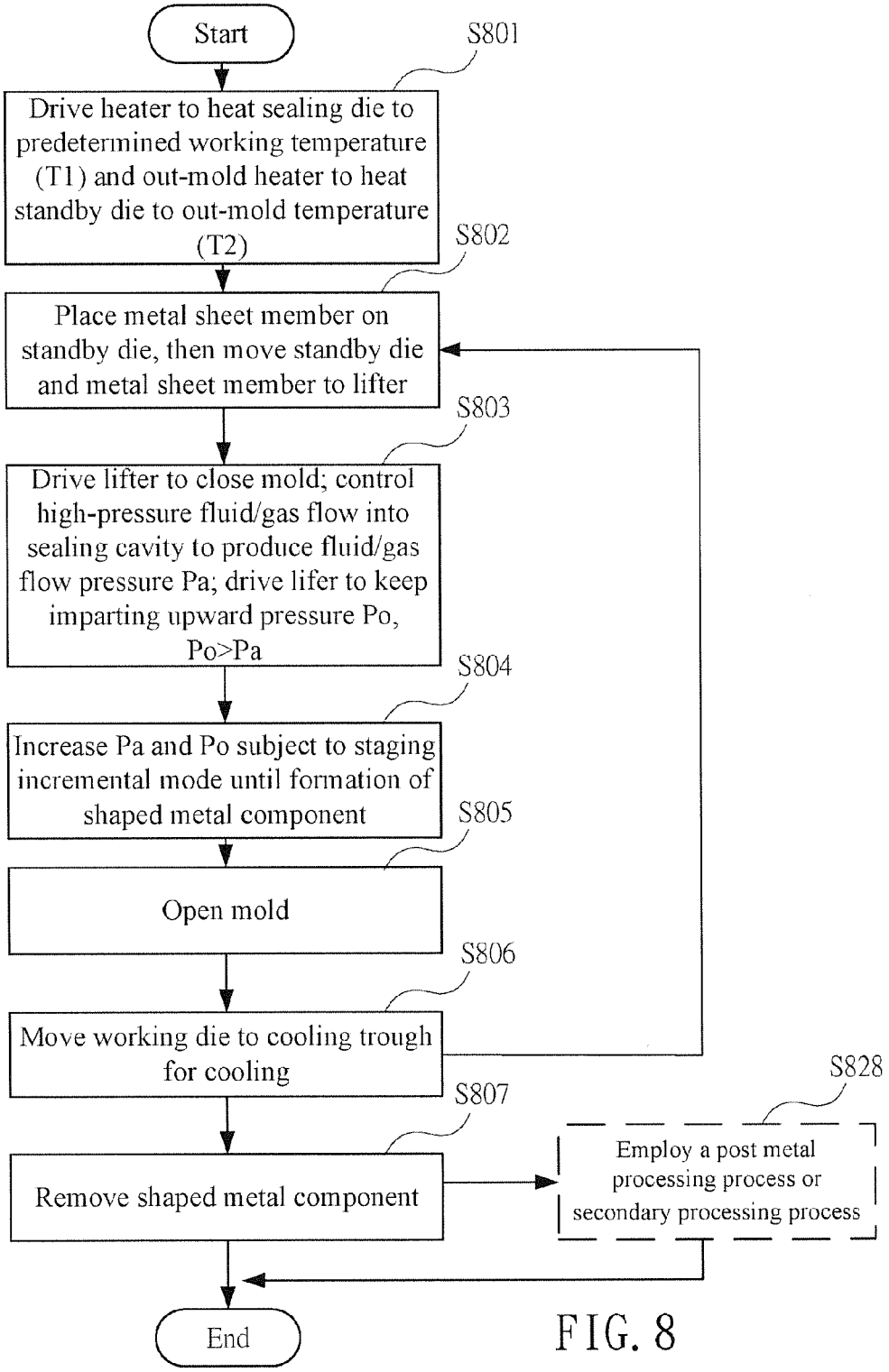
FIG. 8 is a flow chart of an alternate form of the sheet metal member shape forming method in accordance with the present invention.

Referring to FIG. 8, an alternate form of the sheet metal member shape forming method in accordance with the present invention is shown. Referring also to FIG. 3, this alternate form of a sheet metal member shape forming method includes the following steps:

Step S801 The control unit 50 controls and drives the heater 23 to heat the sealing die 211 to a predetermined working temperature T1, and also controls and drives the out-mold heater 25 to heat a standby die 2155 to a predetermined out-mold temperature T2.

Step S802 The material feeding unit 60 is controlled to move a sheet metal member 65 from a room temperature condition onto the top side of the standby die 2155, and then to move the standby die 2155 and the sheet metal member 65 to the top side of the lifter 31 at the molding zone 200, enabling the standby die 2155 to become a working die 2151.

Step S803 The control unit 50 controls and turns on the lift unit 30, moving the lifter 31 to lift the working die 2151 upwardly toward the sealing die 211, thereby closing the mold 21, and at this time, the sheet metal member 65 is kept between the sealing die 211 and the working die 2151 and indirectly heated by the heater 23 via the sealing die 211 and the working die 2151.

When the mold 21 is closed or the lifter 31 is started, the fluid/gas flow supply source 40 starts to provide a high-pressure fluid/gas flow 49 to the sealing cavity 212 through the gas delivery pipe 43 and the air hole 213, imparting a fluid/gas flow pressure Pa on the inside of the sealing cavity 212 and the surface of the sheet metal member 65. At the same time, the lifter 31 of the lift unit 30 keeps moving the working die 2151 upwardly to give an upward pressure Po to the mold 21. This upward pressure Po is greater than the fluid/gas flow pressure Pa (Po>Pa), preventing the fluid/gas flow pressure Pa from causing the mold 21 to leak.

Step S804 The upward pressure Po provided by the lifter 31 and the fluid/gas flow pressure Pa provided by the high-pressure fluid/gas flow 49 are respectively increased, stage-by-stage, enabling the fluid/gas flow pressure Pa to force the softened sheet metal member 65 against the inner surface of the shape-forming die 215, forming a shaped metal component 67.

Step S805 The control unit 50 controls the lifter 31 of the lift unit 30 to move the working die 2151 and the shaped metal component 67 downwardly away from the sealing die 211, i.e., performing a mold-opening procedure.

Step S806 After opened the mold 11, the material transfer unit 61 moves the working die 2151 out of the molding zone 200, and transfers the working die 2151 with the shaped metal component 67 to a cooling trough 70 to lower the temperature. At this time, the shape-forming die 215 is directly cooled down in the cooling trough 70, and the shaped metal component 67 is cooled down indirectly through the shape-forming die 215.

Step S807 Remove the shaped metal component 67 from the working die 2151 after the working die 2151 and the shaped metal component 67 are lowered to a predetermined temperature value, finishing the formation of the shaped metal component 67.

When moving the working die 2151 and the shaped metal component 67 to the cooling trough 70, the control unit 50 performs Step S802, starting a next shape forming cycle. At this time, the material feeding unit 60 moves another sheet metal member 65 under room temperature conditions to the top side of another standby die 2155 that has been pre-heated to the out-mold temperature T2 at the out-mold heating zone 24, and then moves the standby die 2155 with the sheet metal member 65 to the top side of the lifter 31.

Step S828 Employ a post metal processing process or secondary processing process to treat the shaped metal component 67 subject to different reasons, such as surface stress, coloring, low-temperature tempering treatment, surface treatment, or anodizing treatment.

The foregoing description is merely one embodiment of the present invention and not considered as restrictive. All equivalent variations and modifications in shape, structure, feature, and spirit in accordance with the appended claims may be made without in any way from the scope of the invention.

What is claimed is:

1. A sheet metal member shape forming system, comprising:

a mold consisting of a sealing die and a shape-forming die, said sealing die and said shape-forming die being arranged in such a manner that the distance between said sealing die and said shape-forming die is changeable, said sealing die defining therein a sealing cavity at least one air hole, said shape-forming die defining therein a shape-forming cavity, said shape-forming die being adapted for holding a sheet metal member at a top side thereof between said shape-forming die and said sealing die;

a heater arranged around said mold and adapted for heating said mold;

an out-mold heating zone having installed therein a standby die and an out-mold heater, said out-mold heater being adapted for heating said standby die to have said standby die provide an out-mold temperature;

a material feeding unit adapted for feeding a sheet metal member kept under room temperature conditions onto a top side of said standby die outside said out-mold heating zone for enabling said sheet metal member to be moved with said standby die to said mold;

a fluid/gas flow supply source connected to said at least one air hole of said sealing die and adapted for providing a high-pressure fluid/gas flow into said sealing cavity to impart a fluid/gas flow pressure on said sheet metal member;

a lift unit carrying said shape-forming die and adapted for moving said shape-forming die up and down relative to said sealing die between a mold-closing status where said shape-forming die and said sealing die are closed and a mold-opening status where said shape-forming die and said sealing die are opened, said lift unit being controllable to keep moving said shape-forming die toward said sealing die after reaching said mold-closing status to impart an upward pressure on said shape-forming die against said sealing die, said upward pressure being greater than said fluid/gas flow pressure; and a control unit connected to said lift unit, said fluid/gas flow supply source, said material feeding unit, said out-mold heater and/or said heater.

2. The sheet metal member shape forming system as claimed in claim 1, wherein said upward pressure is greater than said fluid/gas flow pressure by 10%~40%.

3. The sheet metal member shape forming system as claimed in claim 2, wherein said upward pressure is preferably greater than said fluid/gas flow pressure by 18%~27%.

4. The sheet metal member shape forming system as claimed in claim 1, wherein said high-pressure fluid/gas flow is selected from the group of fluid, air, inert gas and/or inactive gas.

5. The sheet metal member shape forming system as claimed in claim 1, wherein said fluid/gas flow pressure and said upward pressure are applied to said sheet metal member and said mold subject to a staging incremental mode, said staging incremental mode comprising at least one variation time segment and at least one stagnation time segment, said fluid/gas flow pressure and said upward pressure being continuously increased during each said variation time segment, said fluid/gas flow pressure and said upward pressure remaining unchanged during each said stagnation time segment.

6. The sheet metal member shape forming system as claimed in claim 1, wherein said lift unit comprises at least one sliding rail or sliding groove disposed at a top side thereof; said shape-forming die comprises at least one sliding groove or sliding rail disposed at a bottom side thereof for slidably coupling to the at least one sliding rail or sliding groove of said lift unit.

7. The sheet metal member shape forming system as claimed in claim 1, wherein said heater is selected from the group of electric heating coil and high-frequency heater; said lift unit comprises a hydraulic machine.

* * * * *